US005902418A

United States Patent [19]

Takemura et al.

[11] Patent Number: 5,902,418

[45] Date of Patent: May 11, 1999

[54] METHOD FOR MANUFACTURING CRT INTERIOR PARTS

[75] Inventors: Taketoshi Takemura; Toshikazu Karita; Masayuki Yamamoto, all of Tokyo, Japan

[73] Assignee: Mitsubishi Denki Kabushiki Kaisha, Tokyo, Japan

[21] Appl. No.: 08/759,001

[22] Filed: Dec. 2, 1996

[30] Foreign Application Priority Data

Jun. 26, 1996 [JP] Japan ..... 8-165722

[51] Int. Cl.[6] ..... C23C 8/04

[52] U.S. Cl. ..... 148/280; 148/283; 148/287; 428/472.1

[58] Field of Search ..... 148/280, 283, 148/287, 472.1

[56] References Cited

U.S. PATENT DOCUMENTS

| | | | |
|---|---|---|---|
| 4,035,200 | 7/1977 | Valentijn | 148/283 |
| 4,294,436 | 10/1981 | Takahashi | 266/257 |
| 4,692,659 | 9/1987 | Takenaka et al. | 313/402 |
| 4,992,113 | 2/1991 | Baldo et al. | 148/208 |
| 5,167,557 | 12/1992 | Teramoto et al. | 148/222 |

*Primary Examiner*—David A. Simmons
*Assistant Examiner*—Robert R. Koehler

[57] ABSTRACT

A method for manufacturing CRT interior parts made of material such as of iron or steel has the steps of: introducing hydrocarbon and air into a conversion furnace, thereby producing an exothermic gas; cooling the exothermic gas to a predetermined temperature higher than a dew point of the exothermic gas; and introducing the exothermic gas at a temperature higher than the dew point into a blackening furnace which houses the CRT interior parts, thereby producing a blackened film on a surface of each of the CRT interior parts. The blackened film is mainly consisting of $Fe_3O_4$. The temperature of the exothermic gas, when introduced in the blackening furnace, may be higher than a boiling point of each component composing the exothermic gas.

9 Claims, 2 Drawing Sheets

METHOD FOR MANUFACTURING CRT INTERIOR PARTS

BACKGROUND OF THE INVENTION

The present invention relates to a method for manufacturing CRT (cathode-ray tube) interior parts which includes a step of forming a blackened film mainly consisting of $Fe_3O_4$ (triferric tetraoxide) on a surface of each of CRT interior parts such as a shadow mask, an aperture grilles a frame for supporting them and an internal magnetic shield, and to a manufacturing device for implementing this method.

Two methods are known for producing a blackened film on a surface of steel parts, i.e., a steam treatment method when using a steam atmosphere and a gas treatment method using an exothermic gas. However, when using the steam treatment method, it is necessary to form a blackened film of at least 5 [$\mu$m] thickness in order that the blackened film can provide enough and stable protective function. Moreover, the blackened film may contain not only $Fe_3O_4$ but also $Fe_2O_3$ (diferric trioxide), or may contain a larger proportion of $Fe_2O_3$ than $Fe_3O_4$, and blackened film powder may drop off to cause clogging of the shadow mask. The gas treatment method is, therefore, largely used for important CRT interior parts, since it gives very little $Fe_2O_3$ and forms a highly protective thin film of approximately 0.3 [$\mu$m] thickness.

FIG. 2 is a block diagram showing the construction of a conventional manufacturing device of CRT interior parts. In such a conventional manufacturing device, a DX gas generator for non-oxidative annealing of iron, steel, non-ferrous metals or alloys was used to manufacture steel parts such as CRT Interior parts. The manufacturing device of FIG. 2 produces an exothermic gas 13 in a conversion furnace (combustion chamber) 3 from a gaseous mixture of hydrocarbons 11 and air 12 mixed in a mixer 1. The exothermic gas 13 is then cooled to approximately 5 [°C.] and moisture is removed in a cooler 8 to give a DX gas 15. The DX gas 15 passes through a hot water shower at 60 [°C.] generated by a humidifier 9, and after being reheated to approximately 500 [°C.] (oxidizing temperature) by a heater 10, it is led into a blackening furnace 7 containing CRT interior parts.

However, in the conventional manufacturing device of CRT interior parts, a large energy loss was involved as the DX gas 15 formed by cooling to 5 [°C.] and dehumidifying is re-humidified and reheated.

Further, the humidifier 9 requires difficult maintenance such as rustproofing.

Further, due to a shift of the dew point resulting from instability of the humidifying conditions produced by the humidifier 9, there was dispersion in the thickness and properties of the blackened film.

SUMMARY OF THE INVENTION

It is an object of the present invention to provide a method for manufacturing CRT interior parts with low energy losses and capable of forming a fine, uniform blackened film, which is thin but has stable protective properties, and a manufacturing device of CRT interior parts having simple construction for implementing this method.

According to the present invention, a method for manufacturing CRT interior parts made of material including at least one of iron and steel, has the steps of: introducing hydrocarbon and air into a conversion furnace, thereby producing an exothermic gas; cooling the exothermic gas to a predetermined temperature higher than a dew point of the exothermic gas; and introducing the exothermic gas at a temperature higher than the dew point into a blackening furnace which houses the CRT interior parts, thereby producing a blackened film on a surface of each of the CRT interior parts. The blackened film is mainly consisting of $Fe_3O_4$.

It is desirable that the the temperature of the exothermic gas, when introduced in the blackening furnace, is higher than a boiling point of each component composing the exothermic gas.

It is desirable that a step of drying the air is added before the step of introducing the hydrocarbon and the air.

It is also desirable that a step of eliminating oxidizing gases from the air is added before the step of introducing the hydrocarbon and the air.

It is also desirable that a step of adding a gas containing oxygen to the exothermic gas is added before the step of introducing the exothermic gas into the blackening furnace.

It is also desirable that the gas containing oxygen is air, an amount of which lies within a range of 5 [volume %] to 30 [volume %] relative to the exothermic gas.

It is also desirable that a step of drying the gas containing oxygen is added before the step of adding the gas containing oxygen.

It is also desirable that a step of eliminating oxidizing gases from the gas containing oxygen is added before the step of adding the gas containing oxygen.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

A preferred embodiment of the present invention will now be described in detail with reference to the accompanying drawing.

Figure 1:
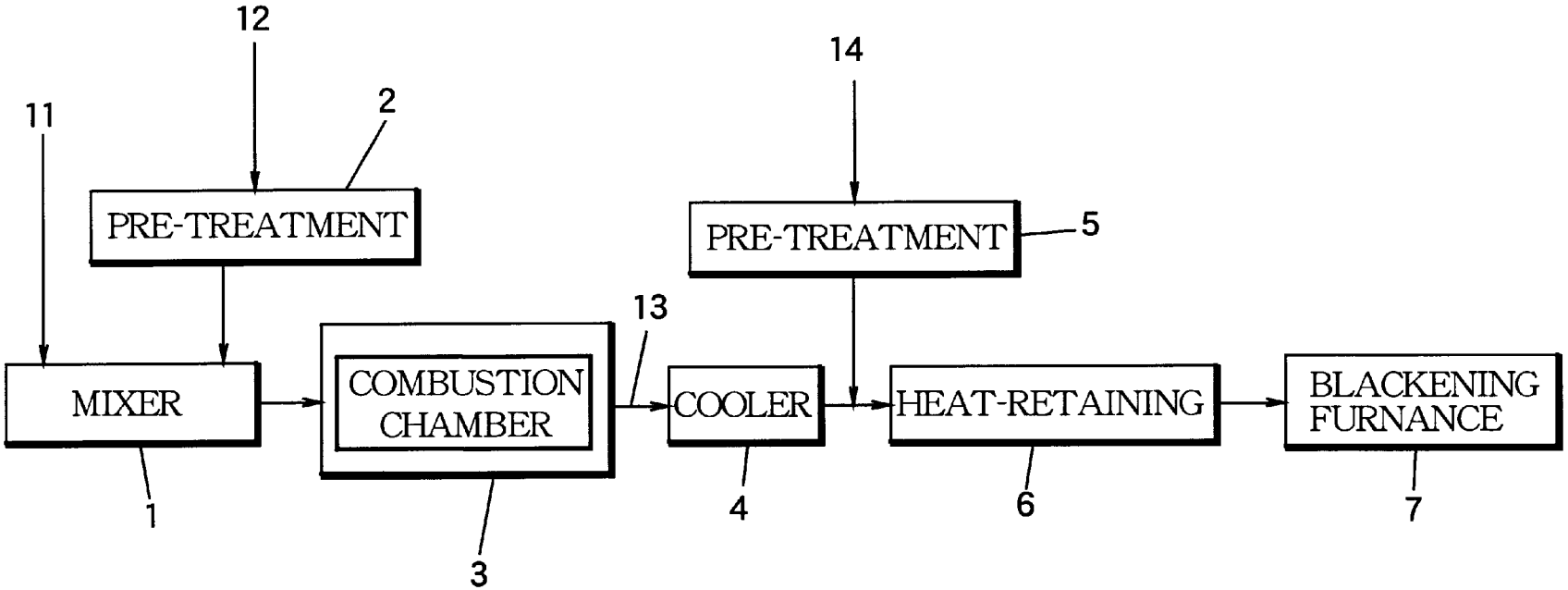
FIG. 1 is a block diagram showing the construction of a manufacturing device of CRT interior parts according to the present invention.

FIG. 1 is a block diagram showing the construction of a manufacturing device of CRT interior parts according to the present invention. As shown in FIG. 1, the manufacturing device of CRT interior parts comprises a mixer 1 for mixing hydrocarbon 11 and air 12, a pre-treatment section 2 for drying the air 12 to be led into the mixer 1 and removing oxidizing gases such as sulfur oxides ($SO_x$) and nitrogen oxides ($NO_x$) from the air 12, and a conversion furnace (combustion chamber) 3, into which the gas mixture of the hydrocarbon 11 and the air 12 mixed in the mixer 1 is led, to produce an exothermic gas 13.

The hydrocarbon 11 led into the mixer 1 may be methane ($CH_4$), which is the principal constituent of natural gas, and also that of town gas, or others, such as propane ($C_3H_8$), butane ($C_4H_{10}$), or mixture of them. When LP gas (e.g. a mixture of propane and butane) is used, the mixing ratio of propane to butane must be adjusted to be constant before introducing in the conversion furnace 3 to avoid dispersion of blackening power.

The aforesaid pre-treatment section 2 dries the air 12, for example, using a molecular sieve. This is because the water vapor pressure of air in summer when it is humid (at air temperature 30 [°C.] and relative humidity 80 [%]) is 25.5 [mmHg] ((saturation water vapor pressure at 30 [°C.])× (relative humidity)=31.83 [mmHg]×0.8=25.5 [mmHg]), whereas the water vapor pressure of air in winter when it is dry (at air temperature 10 [°C.] and relative humidity 40 [%]) is 3.7 [mmHg] ((saturation water vapor pressure at 10 [°C.])×(relative humidity)=9.205 [mmHg]×0.4=3.7 [mmHg]), and if the air 12 were introduced without drying, the blackening power would vary depending on the environment. Moreover, the pre-treatment section 2 removes oxidizing gases from the air 12 using, for example, a molecular sieve. This is because if oxidizing gases are mixed with the air 12, $Fe_2O_3$ increases in the blackened film formed on the surface of each CRT interior parts.

In the aforesaid conversion furnace 39 the hydrocarbon 11 is burnt (the theoretical combustion temperature is 2000 [°C.] or more), and exothermic gas 13 at a temperature of 1500 [°C.] or over is produced.

The manufacturing device of CRT interior parts according to this embodiment also comprises a cooler 4 which cools the exothermic gas 13 to a predetermined temperature above its dew point, a pre-treatment section 5 which dries air 14 to be added to the exothermic gas 13 and removes oxidizing gases such as sulfur oxides ($SO_x$) and nitrogen oxides ($NO_x$) from the air 14, a heat-retaining section 6 which keeps in the heat of the exothermic gas 13 within the passage of the gas 13 to which the air 14 is added, and a blackening furnace 7 housing CRT interior parts (not shown) consisting of iron or steel such as a shadow mask, an aperture grille, a frame for supporting these parts, and an internal magnetic shield, into which the exothermic gas 13 at a higher temperature than its dew point is led to produce a blackened film which mainly consists of $Fe_3O_4$ on the surfaces of these CRT interior parts.

The aforesaid cooler 4 may, for example, water-cool the exothermic gas 13 at a temperature of 1500 [°C.] or above produced in the conversion furnace 3, to a temperature of about 500 [°C.] (oxidizing temperature). The exothermic gas 13 is at a high temperature of 1500 [°C.] or above immediately after discharge from the conversion furnace 3, hence it is desirable that the cooler 4 be installed in the vicinity of the outlet of the conversion furnace 3 from the viewpoint of heat resistance and corrosion resistance of the piping.

As in the case of the pre-treatment section 2, the aforesaid pre-treatment section 5 eliminates moisture and oxidizing gases, for example, by means of a molecular sieve. The reason why the air 14, which is a gas containing oxygen ($O_2$), is added to the exothermic gas 13, is that it reduces the amount of carbon monoxide (CO) and hydrogen ($H_2$), components which inhibit blackening, and increases carbon dioxide ($CO_2$) and water ($H_2O$), components which promote blackening, in the exothermic gas 13. Hence blackening power can be enhanced in the region of 500 [°C.], a temperature at which blackening power may not otherwise be sufficient. Further, it is desirable that the air 14 which is added is in the range of 5 [volume %]–30 [volume %] relative to the exothermic gas 13. Gases containing oxygen with other components may be added instead of the air 14.

The aforesaid heat-retaining section 6 comprises a heat insulating material and a heater. The exothermic gas 13 cooled to 500 [°C.] by the cooler 4 is led without modification into the blackening furnace 7 via heated pipes. This is because there is a risk that, if the temperature falls below the dew point, condensation might occur so that moisture adheres to the inside of the pipe, blackening power is impaired or varies, and the blackened film is non-uniform. Also if moisture adheres to the inside of the pipe, it may rust the inner wall of the pipe. The exothermic gas 13 of which the dew point is adjusted, is therefore kept hot or heated by the heat-retaining section 6 in the line up to the blackening furnace 7 so that it does not cool below its dew point. Provided that the temperature of the exothermic gas 13 does not fall below the boiling point of water, condensation can be definitively prevented.

Next, a method for manufacturing CRT interior parts using the manufacturing device of FIG. 1 will be described.

First, the hydrocarbon 11 and the air 12 which has been dried and from which oxidizing gases have been removed by the pre-treatment section 2, are introduced in the mixer 1 where they are mixed. Next, the mixture of the hydrocarbon 11 and the air 12 which have been mixed in the mixer 1, is introduced in the conversion furnace 3 where the exothermic gas 13 is produced. Next, the exothermic gas 13 is cooled to a predetermined temperature above its dew point by the cooler 4. Next, the gas 14 (i.e., air) containing oxygen, which has been dried and from which oxidizing gases have been eliminated by the pre-treatment section 5, is introduced and mixed with the exothermic gas 13, the exothermic gas 13 is transported while it is kept hot, and then the exothermic gas 13 at a higher temperature than its dew point is introduced in the blackening furnace 7 housing the CRT interior parts so as to produce the blackened film on the surface of these parts.

As described hereinabove, according to the manufacturing device of FIG. 1 or the manufacturing method using this device, the exothermic gas 13 is not allowed to fall below its dew point, so energy losses are reduced, blackening power is not insufficient and an uniform blackened film is formed. Further, as the starting material air 12 is dried, the composition of the exothermic gas 13 is maintained constant even when the atmospheric conditions change, and the quality of the blackened film is uniform. Further, as oxidizing gases are eliminated from the air 12 which is a starting material, the inclusion of $Fe_2O_3$ in the blackened film is prevented, and as the air 14 is mixed with the exothermic gas 13 before the blackening treatment, blackening power is enhanced.

Figure 2:
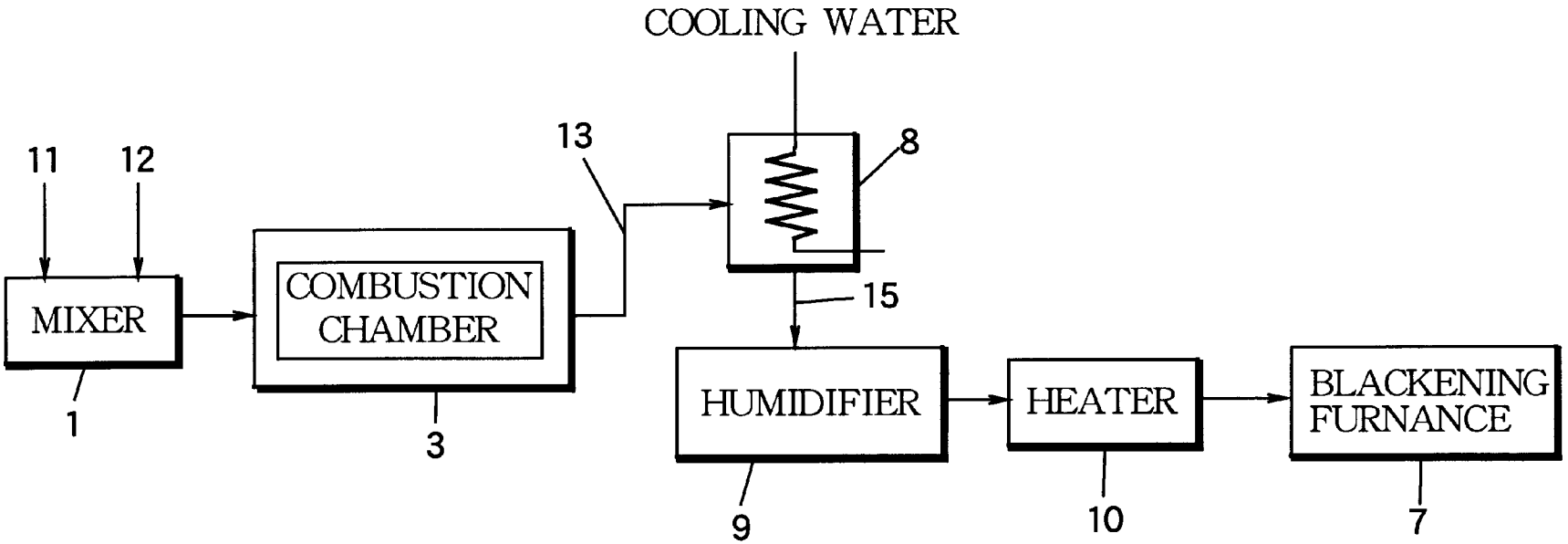
FIG.2 PRIOR ART
FIG. 2 is a block diagram showing the construction of a conventional manufacturing device of CRT interior parts.

Next, the energy loss will be calculated for the case where the principal constituent of the hydrocarbon starting material is methane ($CH_4$) when the exothermic gas 13 is maintained at 300 [°C.] before introducing it in the blackening furnace 7 (which is the case of the present invention), and the case when the exothermic gas 13 is reheated to 300 [°C.] after its temperature has first dropped to 60 [°C.] (the conventional case of FIG. 2).

First, assuming that the air composition is nitrogen ($N_2$): oxygen ($O_2$)=79 [volume %]:21 [volume %], and also assuming the theoretical combustion, in which, the air ratio (air volume used/air volume theoretically needed for combustion) is 1.0 (through in the practical combustion, this value exceeds 1), the chemical reaction which occurs in the conversion furnace 3 may be represented by the following chemical equation:

$$CH_4+2O_2=CO_2+2H_2O\ 7.52\ N_2=7.52\ N_2$$

where the 7.52 obtained from 2×(0.79/0.21) corresponds to the mole number of $N_2$, accompanying 2 moles of $O_2$ and retaining without reaction after 1 mole of $CH_4$ is burnt.

In the generated exothermic gas, the mole numbers for component gases of $CO_2$, $H_2$, and $N_2$ are 1, 2, and 7.52, respectively, then sum of them is 10.52.

Using these values, the compositional ratios of each component may be calculated as follows:

$CO_2$:(1/10.52)×100=9.5 [%]

$H_2O$: (2/10.52)×100=19.0 [%]

$N_2$: (7.52/10.52)×100=71.5 [%]

Water vapor pressure=760 [mmHg]×0.19=144.4 [mmHg] and the dew point then corresponds to 59.3 [°C.]. If this gas is cooled to +5 [°C.], water vapor pressure becomes 6.54 [mmHg], i.e., 95.5 [%] of water is eliminated. This fact may be established from the following equation:

$$\{(144.4-6.54)/144.4\}\times 100=95.5\ [\%]$$

The amount of water then changes, equilibrium is destroyed and a compositional change occurs in accordance with the following equation so as to reach a new equilibrium:

$$CO_2+H_2=CO+H_2O$$

The gas specific heat [kcal/Nm$^3$.°C.] at 200 [°C.] is 0.312 [kcal/Nm$^3$.°C.] for $N_2$ and CO, 0.431 [kcal/Nm$^3$.°C.] for $CO_2$ and 0.362 [kcal/Nm$^3$.°C.] for $H_2O$. This specific heat is used in the following calculation. The lower heat value of $CH_4$ is also 8570 [kcal/Nm$^3$.°C.].

Assuming that the heating temperature of the blackening furnace is 500 [°C.] and the flow rate of the exothermic gas 13 is 100 [Nm$^3$/h], the (300-60) [°C.] sensible heat of exothermic gas may be found. The exothermic gas contains nearly 1 [%] CO, however as $N_2$, which is also a diatomic molecule, has the same specific heat, CO may be considered as $N_2$, and the theoretical combustion may be assumed.

(1) Sensible heat of $CO_2$ for a composition ratio of 9.5 [%]:

$$100\ [Nm^3/h]\times 0.095\times 0.43\ [kcal/Nm^3.°C.]\times(300\text{-}60)\ [°C.]=980\ [kcal/h]$$

(2) Sensible heat of $H_2O$ for a composition ratio of 19.0 [%]:

$$100\ [Nm^3/h]\times 0.190\times 0.36\ [kcal/Nm^3.°C.]\times(300\text{-}60)\ [°C.]=1642\ [kcal/h]$$

(3) Sensible heat of $N_2$ for a composition ratio of 71.5 [%]:

$$100\ [Nm^3/h]\times 0.715\times 0.31\ [kcal/Nm^3.°C]\times(300\text{-}60)\ [°C.]=5320\ [kcal/h]$$

From the above-mentioned equations (1) to (3), the total sensible heat is:

$$980+1642+5320=7942\ [kcal/h].$$

As the combustion energy of $CH_4$ is:

$$100\ [Nm^3/h]\times(1/10.52)=9.5\ [Nm^3/h]$$

$$9.5\ [Nm^3/h]\times 8570\ [kcal/Nm^3]=81415\ [kcal/h]$$

the total sensible heat of exothermic gas corresponds to:

$$(7942/81415)\times 100=9.75\ [\%]$$

of the combustion energy of $CH_4$.

In other words, it is seemed that if the exothermic gas 13 is first cooled to 60 [°C.], its dew point is adjusted and it is then reheated to 300 [°C.], instead of cooling it from the combustion temperature of 1500 [°C.] or over to 300 [°C.] and introducing it into the blackening furnace 7, and it is assumed that methane is used for the heating, approximately 10 [%] more methane, which is the starting gas for exothermic gas, is needed. Also when electrical energy is used to heat the exothermic gas 13, even more methane is required in terms of cost.

Next, we will consider the effect of CO in the exothermic gas 13. Some CO is contained in the exothermic gas, when hydrocarbon is burnt with less air than that for theoretical combustion. Moreover, the CO is inevitably produced in the blackening process by the following chemical reactions:

$$Fe_2+CO_2=FeO+CO$$

$$3Fe_2O+CO_2=Fe_3O_4+CO$$

$$2Fe_3O_4+CO_2=3Fe_2O_3+CO$$

It is therefore considered appropriate to set the air ratio so that some CO is contained in the exothermic gas 13. Further, the fact that the blackened film produced by gas treatment is thinner than that produced by steam treatment, contains little $Fe_2O_3$ and effectively comprises only $Fe_3O_4$ is thought to be due to the CO which is present from the beginning. There is a possibility that the blackened film produced by gas treatment contains a very small amount of C (according to an ion microanalyzer), the C produced by the following reaction apparently playing a part in the blackening process:

$$2CO=CO_2+C$$

(EXAMPLE 1)

The air ratio of the air 12 introduced in the mixer 1 was 0.95, and setting the dew point to 60 [°C.], the first part of the piping was electrically heated from outside and the remaining piping was kept warm by an insulating material. The air 14 was added in the proportions of 2.5 [volume %]. 5 [volume % ], 10 [volume %], 20 [volume %], 25 [volume %], 30 [volume %] or 35 [volume %]. An aperture grille test piece (made of very low carbon steel containing nitrogen) in the blackening furnace 7 was blackened under these conditions in exothermic gas at a maximum temperature of 470 [°C.] for 15 [min]. As a result, when the addition amount of the air 14 was less than 5 [volume %], the blackened film was rather thin and uneven, whereas when the addition amount of the air 14 exceeded 30 [volume %], there was some unevenness although the film was sufficiently black. The addition amount of the air 14 therefore preferably lies within the range of 5 [volume %] to 30 [volume %].

(EXAMPLE 2)

The air ratio of the air 12 introduced in the mixer 1 was 0.95, and setting the temperature of the hot water in the cooler 4 to 80 [°C.], adjustment was made so that the temperature of the gas was 200 [°C.] and its dew point was approximately 60 [°C.] at the inlet to the blackening furnace 7. The addition amount of the air 14 was 25 [volume %]. The aperture grille test piece (made of very low carbon steel containing nitrogen) in the blackening furnace 7 was blackened under these conditions. As a result, a blackened film similar to that in the case of an air addition amount of 10 [volume %] to 30 [volume %] in Example 1 was formed. Also, when moisture was removed from the added air, a more uniform blackened film without any unevenness was obtained.

(EXAMPLE 3)

A core tube was introduced in a tubular furnace, and the ends of the core tube were connected by capillary tubes to an air inlet tube and an air discharge tube. $CO_2$, $H_2O$, $N_2$ were then allowed to flow into the core tube from the air inlet tube at a total flow rate of 5 [milliliter/min] to give the theoretical combustion composition. Five aperture grille test pieces, size 30 [mm]×30 [mm], were arranged in the core tube, and heating was performed under these conditions at 470 [°C.]×15 [min]. As a comparison, 1 [volume %] of sulfur dioxide ($SO_2$) was added to the gas and the same test was performed, the remaining conditions being identical.

When $SO_2$ was not added, an uniform blackened film was formed, however in the comparative example when $SO_2$ was added, a reddish unevenness appeared in the blackened film, and $Fe_2O_3$ was detected by X-ray diffraction. Normally, 1 [%] $SO_2$ is not present in the atmosphere, however this shows that $SO_2$ is one factor responsible for admixture of $Fe_2O_3$ and elimination of $SO_2$ is therefore desirable. For the same reason, it is desirable to eliminate other oxidizing gases such as $NO_x$.

What is claimed is:

1. A method for manufacturing CRT interior parts made of a material including at least one of iron and steel, comprising:

introducing hydrocarbon and air into a conversion furnace, thereby producing an exothermic gas;

cooling said exothermic gas to an oxidizing temperature, higher than a dew point of said exothermic gas, maintaining said oxidizing temperature; and introducing said exothermic gas having said maintained oxidizing temperature higher than said dew point, into a blackening furnace, which houses said CRT interior parts, thereby forming a blackened film on a surface of each of said CRT interior parts, said blackened film being mainly consisting of $Fe_3O_4$.

2. A method of claim 1, wherein said temperature of said exothermic gas, when introduced in said blackening furnace, is higher than a boiling point of each component composing said exothermic gas.

3. A method of claim 1, further comprising:

drying said air before said step of introducing said hydrocarbon and said air.

4. A method of claim 1, further comprising:

eliminating oxidizing gases from said air before said step of introducing said hydrocarbon and said air.

5. A method of claim 1, further comprising:

adding a gas containing oxygen to said exothermic gas before said step of introducing said exothermic gas into said blackening furnace.

6. A method of claim 5, wherein said gas containing oxygen is air, an amount of which lies within a range of 5 [volume %] to 30 [volume %] relative to said exothermic gas.

7. A method of claim 5, further comprising:

drying said gas containing oxygen before said step of adding said gas containing oxygen.

8. A method of claim 5, further comprising:

eliminating oxidizing gases from said gas containing oxygen before said step of adding said gas containing oxygen.

9. A method of forming a $Fe_3O_4$ layer on a surface of an element made of at least one of iron and steel by introducing an exothermic gas having an oxidizing temperature to the element, comprising:

combusting hydrocarbon and air to generate the exothermic gas;

cooling the exothermic gas to the oxidizing temperature;

maintaining the oxidizing temperature obtained in said cooling step; and introducing the exothermic gas having said maintained oxidizing temperature to the element to form the $Fe_3O_4$ layer.

* * * * *